US007534213B2

(12) United States Patent
Shelbourne et al.

(10) Patent No.: US 7,534,213 B2
(45) Date of Patent: May 19, 2009

(54) KNEE EXTENSION TREATMENT APPARATUS

(75) Inventors: K. Donald Shelbourne, Indianapolis, IN (US); Terence S. Sullivan, Carmel, IN (US)

(73) Assignee: Kneebourne Therapeutic, LLC, Noblesville, IN (US)

( * ) Notice: Subject to any disclaimer, the term of this patent is extended or adjusted under 35 U.S.C. 154(b) by 419 days.

(21) Appl. No.: 11/118,981

(22) Filed: Apr. 29, 2005

(65) Prior Publication Data

US 2006/0142673 A1 Jun. 29, 2006

Related U.S. Application Data

(63) Continuation-in-part of application No. 10/237,812, filed on Sep. 9, 2002, now Pat. No. 6,962,570.

(51) Int. Cl.
*A61H 1/02* (2006.01)

(52) U.S. Cl. ..... 601/5; 601/34

(58) Field of Classification Search ..... 601/5, 601/23, 24, 33, 34, 35; 482/95, 96, 907; 602/33, 34, 35, 38, 39, 32, 36
See application file for complete search history.

(56) References Cited

U.S. PATENT DOCUMENTS

| | | | | |
|---|---|---|---|---|
| 661,812 | A | 11/1900 | McKown et al. | |
| 1,144,085 | A | 6/1915 | Ablanalp | |
| 3,612,042 | A | 10/1971 | Fry | 128/25 R |
| 4,100,918 | A | 7/1978 | Glancy | 128/80 F |
| 4,489,713 | A | 12/1984 | Latenser | 128/71 |
| 4,664,099 | A | 5/1987 | Pearl, Jr. | 128/75 |
| 4,665,905 | A | 5/1987 | Brown | 128/80 |
| 4,669,450 | A | 6/1987 | Lindberg | 128/25 B |
| 4,922,892 | A * | 5/1990 | Akcelrod et al. | 601/34 |
| 5,236,333 | A | 8/1993 | Barba, Jr. | 128/25 R |
| 5,253,639 | A | 10/1993 | Johnston | 128/25 R |
| 5,582,579 | A | 12/1996 | Chism et al. | 601/27 |
| 5,687,742 | A | 11/1997 | Johnson | 128/845 |
| 5,820,519 | A | 10/1998 | Slenker | 482/4 |
| 5,931,796 | A | 8/1999 | Kellenberger | 601/34 |
| 6,302,828 | B1 | 10/2001 | Martin et al. | |
| 6,467,713 | B1 | 10/2002 | Watanabe et al. | 242/375.1 |
| 6,669,660 | B2 | 12/2003 | Branch | |
| 2004/0049135 | A1 | 3/2004 | Callanan et al. | |
| 2005/0080371 | A1 | 4/2005 | March et al. | |

OTHER PUBLICATIONS

Information Health Network product brochure, "3×10=0 Full Extension Knee Devices", pp. 1-4, Rev. 4, Dec. 2002, Lansing, Michigan 48909.

* cited by examiner

*Primary Examiner*—Danton DeMille
(74) *Attorney, Agent, or Firm*—Woodard, Emhardt, Moriarty, McNett & Henry LLP

(57) ABSTRACT

A knee extension treatment apparatus for applying a downward force to an upper surface of a user's leg while the leg is supported by the knee extension treatment apparatus, for facilitating the straightening of the leg when bent at the knee, according to one embodiment of the present invention comprises a base frame assembly, an ankle support connected to the base frame assembly, first and second strap assemblies secured to the base frame assembly, each strap assembly being secured at one end and constructed and arranged to lay over the upper surface of the user's leg, a corresponding opposite end of each strap assembly being movable by the user whereby pulling each corresponding opposite end creates a corresponding downward force on the upper surface of the user's leg.

4 Claims, 3 Drawing Sheets

KNEE EXTENSION TREATMENT APPARATUS

REFERENCE TO RELATED APPLICATION

The present application is a continuation-in-part patent application of U.S. patent application Ser. No. 10/237,812, filed Sep. 9, 2002, entitled "Knee Extension Therapy Apparatus", which is now U.S. Pat. No. 6,962,570 and which is hereby incorporated by reference in its entirety.

BACKGROUND OF THE INVENTION

The present invention relates in general to treatment devices that are used to assist with and facilitate the healing and recovery of a patient-user. Such treatment devices may be used before or after surgery or in lieu of surgery. More specifically, the present invention relates to a knee extension treatment apparatus that assists the patient-user with exercising and stretching before and/or following knee surgery. In other instances, the treatment apparatus according to the present invention may be used in lieu of surgery.

It is important that patients recovering from knee surgery initiate knee exercise/stretching treatment promptly after surgery to maintain knee joint flexibility and shorten the period for recovery. Patient compliance with a predetermined physical treatment protocol is key to early patient recovery with optimal joint flexibility and function. In certain situations, benefits are derived by following a knee treatment protocol before surgery. In other situations, a knee treatment protocol may be used in lieu of surgery. While there have been many devices developed to provide knee extension and exercise treatment, each has its complexities or difficulties of use that have tended to reduce patient compliance with therapeutic or treatment protocols designed for early and effective recovery.

The present invention provides a knee extension treatment apparatus that can be easily transported for patient home use, and one that can be used by the post-operative or post-trauma patient with minimal instruction and without assistance of attending medical practitioners, family members or friends. Similarly, the treatment apparatus may be used before or in lieu of surgery. The present invention provides a simple, effective, user adaptable knee extension treatment apparatus. The apparatus is configured to allow the patient-user to lie in a comfortable recumbent position during each treatment session. The apparatus provides an easy-to-use force translation system for efficient and effective delivery of knee straightening forces to areas on the top of the patient's leg. One earlier knee extension treatment apparatus is disclosed in the patent application of Callanan et al., U.S. Ser. No. 10/237,812, filed Sep. 9, 2002, now pending. The Callanan et al. patent application is expressly incorporated by reference herein for its entire disclosure.

The Callanan et al. invention provides a knee extension treatment apparatus for use by a patient in a recumbent position. The patient's hip corresponding to the leg requiring treatment rests on the surface of a base component of the apparatus. The leg requiring extension treatment is elevated to a level above the surface upon which the patient user is resting and is held in position by a height adjustable elevated ankle support. The apparatus is preferably designed to be collapsible into an easily transported unit so that it can be used by the patient at home. The apparatus includes a base having a patient user proximal surface for supporting the patient user's hip and a user distal portion. The apparatus also includes an ankle support member, preferably one of adjustable height mounted on a user distal portion of the base. The apparatus also includes a pulley system for translating a force applied toward the user proximal end of the base and having a major vector component parallel to the surface of the base to a force having a major vector component substantially orthogonal to the base. The pulley system is designed to maintain the tension in the system resulting from the patient applied force. In one embodiment the pulley system enables the applied force to be translated into a mechanically advantaged force having a major component substantially orthogonal to the base. The apparatus also includes a force transmitting element for engaging both knee proximal and knee distal portions of the patient's elevated leg. The force transmitting element has at least one user engageable/disengageable connector for attaching the element to the pulley system for applying the translated based-orthogonal force to areas on the upper surface of the patient's elevated leg proximal and distal of the elevated knee which applied forces tend to straighten the leg and extend the knee joint.

While the earlier Callanan et al. invention is described in the application of U.S. Ser. No. 10/237,812 as being collapsible into a "compact, easily transported unit", there is some degree of complexity in view of the various pulleys, cables, and the ankle support that all have to be disassembled and then reassembled in order to achieve the concept of being collapsible. The present inventors envisioned that improvements could be made to the Callanan et al. structure if the complexity could be reduced and if the new design could be made easier in terms of collapsibility, transporting, storage, and/or set up. Changing to lighter weight materials would add to the convenience of this device so long as the overall structure could be designed with sufficient strength and durability while still using these lighter weight materials, such as tubular metal framing or molded plastic. A further improvement envisioned by the present inventors is to make the collapsed size smaller, thereby making both transport and storage of the apparatus easier. Further, it was envisioned by the present inventors that the pulley mechanism of Callanan et al. could be simplified while retaining the ratchet tightening feature that is under the control of the user by means of a pull cable connected to tightening straps placed over the leg on opposite sides of the knee.

SUMMARY OF THE INVENTION

A knee extension treatment apparatus for applying a downward force to an upper surface of a user's leg while the leg is supported by the knee extension treatment apparatus, for facilitating the straightening of the leg when bent at the knee, according to one embodiment of the present invention comprises a base frame assembly, an ankle support connected to the base frame assembly, first and second strap assemblies secured to the base frame assembly, each strap assembly being secured at one end and constructed and arranged to lay over the upper surface of the user's leg, a corresponding opposite end of each strap assembly being movable by the user whereby pulling each corresponding opposite end creates a corresponding downward force on the upper surface of the user's leg.

One object of the present invention is to provide an improved knee extension treatment apparatus.

Related objects and advantages of the present invention will be apparent from the following description.

DESCRIPTION OF THE PREFERRED EMBODIMENTS

Figure 1:
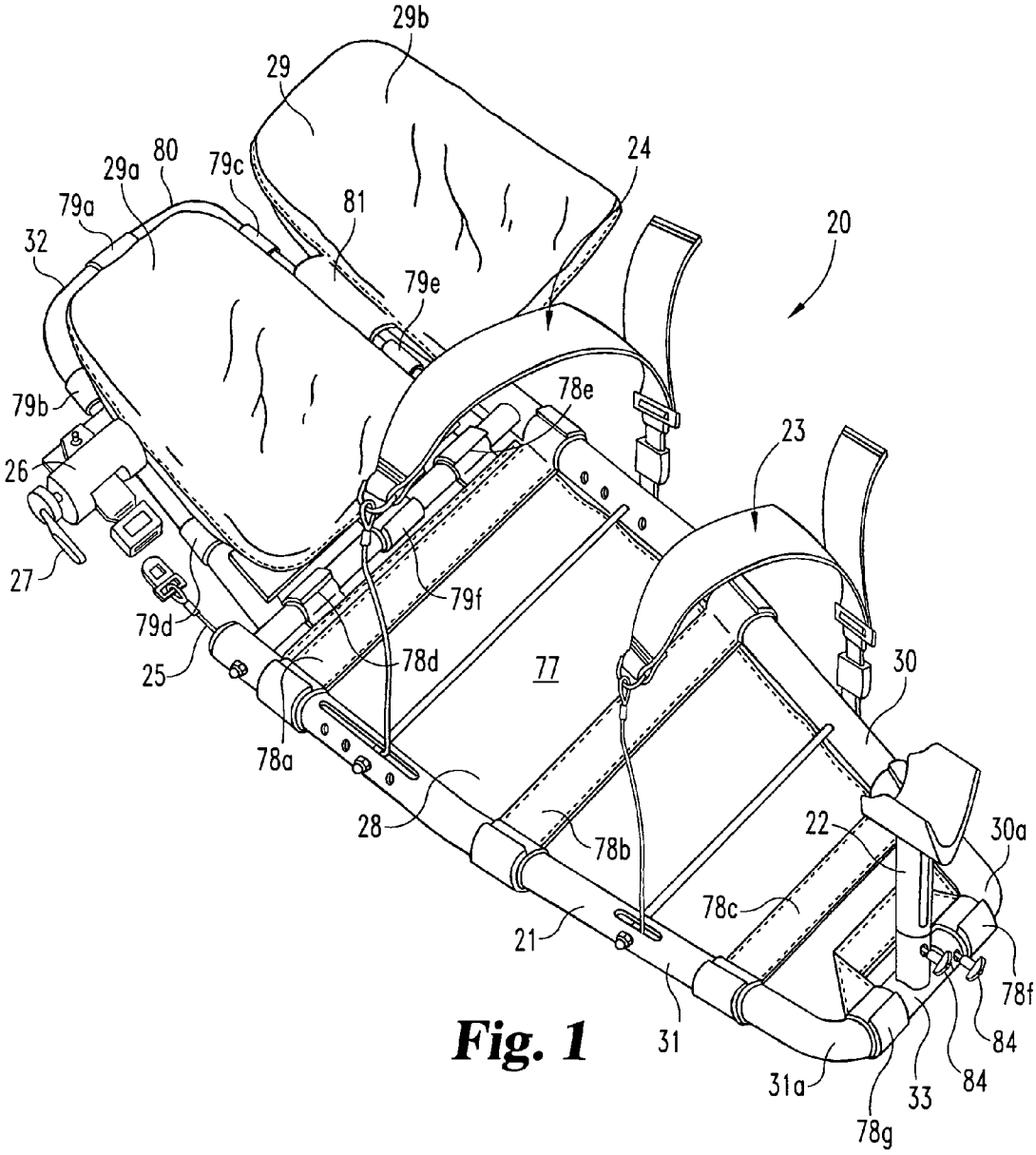
FIG. 1 is a perspective view of a knee extension treatment apparatus according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
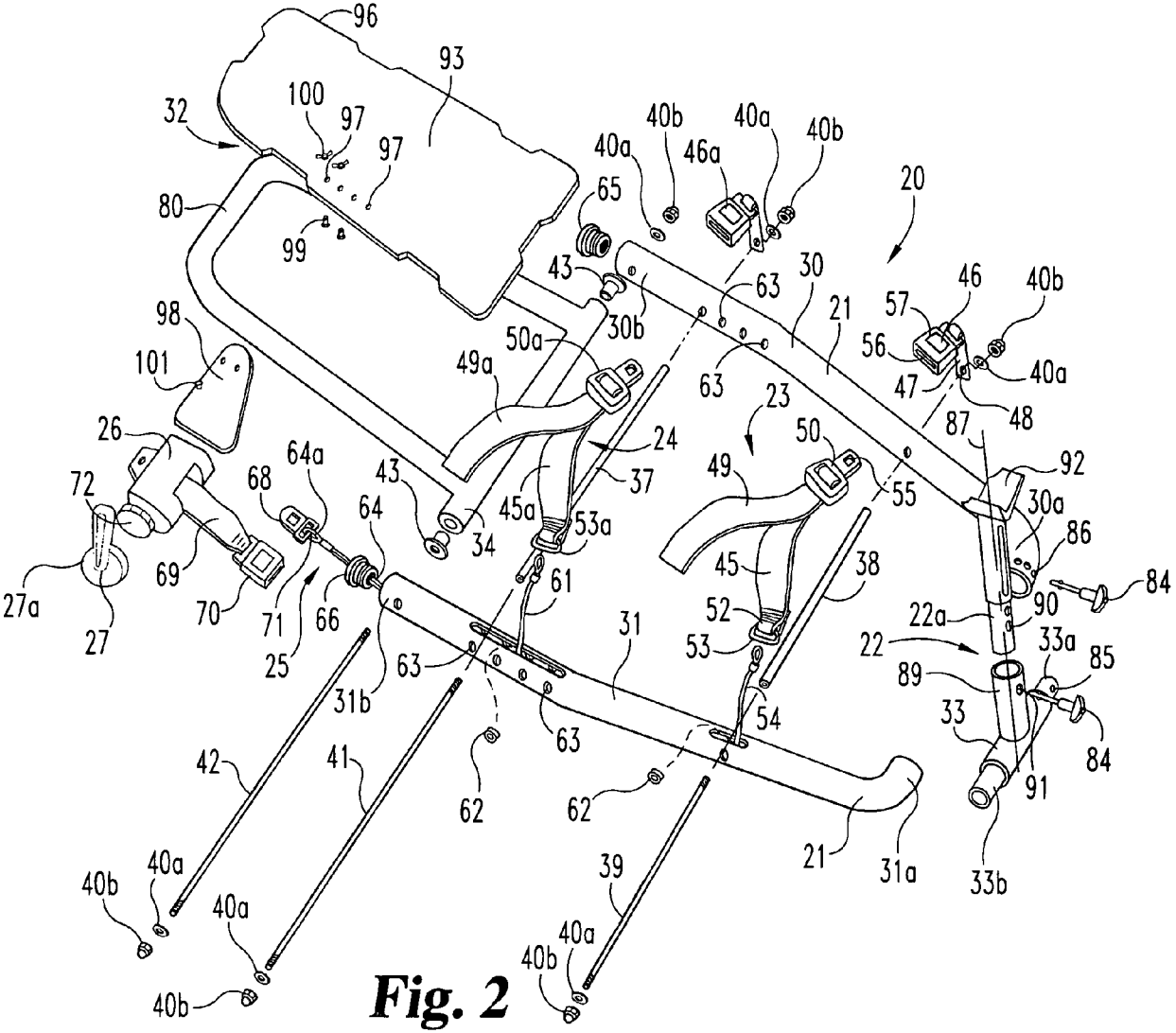
FIG. 2 is an exploded perspective view of the FIG. 1 knee extension treatment apparatus.

Referring to FIGS. 1 and 2, there is illustrated a knee extension treatment apparatus 20 that is constructed and arranged according to the present invention. In the FIG. 1 illustration, the treatment apparatus 20 is opened or unfolded into what would be considered its ready-for-use condition. In this condition, it is ready for use by the individual that may either be a patient recovering from knee surgery, or a would-be patient contemplating knee surgery, or any other individual where some type of treatment for the knee has been recommended or suggested. The patient or would-be patient is the user of apparatus 20 and thus the terms "patient" and "user" or even "patient-user" can be used interchangeably.

The exploded view of FIG. 2 may be preferred in terms of explaining and describing a majority of the component parts that are required for treatment apparatus 20 and the cooperating assembly of those component parts. Once there is a thorough understanding of each component part of treatment apparatus 20 and how those parts are assembled to one another, it will be easy to understand what occurs when changing from the FIG. 1 orientation or arrangement into the folded orientation of FIG. 4 and then back to the FIG. 1 extended or opened arrangement.

With continued reference to FIGS. 1 and 2, it should be noted that the leg slipcover 28 and seat cushion 29 of FIG. 1 are omitted from the FIG. 2 illustration, simply for drawing clarity and to preclude other parts from being hidden from view. Treatment apparatus 20 includes a frame assembly 21, ankle support 22, first strap assembly 23, second strap assembly 24, cable system 25, and manually-adjusted ratcheted pulley 26 with a torque lever 27. Leg slipcover 28 is secured to frame assembly 21 and seat cushion 29 is secured to seat 32.

The frame assembly 21 includes a left-side tubular rail 30, a right-side tubular rail 31, seat 32, and T-section 33. The T-section 33 fits between the distal ends 30*a* and 31*a* of the left-side and right-side rails 30 and 31, respectively. The lower tube 34 of seat 32 extends between proximal ends 30*b* and 31*b* of the tubular rails 30 and 31, respectively.

Hollow tube 37 extends between rail 30 and rail 31 and functions as a brace for added strength and rigidity to frame assembly 21. A second brace is provided by hollow tube 38. Rod 39 is threaded at each end and is of a length sufficient to extend through tube 38 and at one end beyond the outer surface of rail 30 and at the other (opposite) end beyond the outer surface of rail 31. Each threaded end receives a flat washer 40*a* and an acorn hex nut 40*b* for securely tightening the rod 39 and tube 38 assembly to and into the two tubular rails 30 and 31.

Rod 41 is threaded at each end and is similar in construction and purpose to rod 39, except the rod 41 is longer than rod 39 and extends through tube 37. Flat washers 40*a* and acorn hex nuts 40*b* are used for securely tightening this rod and tube assembly to the two tubular rails 30 and 31. Rod 42 is threaded at each end and is constructed and arranged to extend through lower tube 34 and beyond the outer surfaces of each tubular rail 30 and 31. Flat washers 40*a* and acorn nuts 40*b* are used for securing the seat 32 to the tubular rails 30 and 31. Shouldered bushings 43 are used to facilitate the folding forward of the seat 32 relative to the remainder of the apparatus as will be described hereinafter.

The first strap assembly 23 is constructed and arranged similar to an automobile seat belt, including a primary strap portion 45 and a securing buckle 46. Buckle 46 is secured to tubular rail 30 by means of the flexible belt length 47 that includes a clearance hole 48 for receipt of rod 39. Strap portion 45 includes a belt length 49 that is threaded through tongue member 50. Belt length 49 provides for strap extension if added or increased length is needed. Attached end 52 includes a D-ring 53 and belt length 45 is sewn to itself after threading through D-ring 53. Cable 54 is used to securely connect to first strap assembly 23 using D-ring 53. The tip 55 of tongue member 50 is constructed and arranged to be inserted into buckle 46 by way of slot 56. The receipt of tip 55 by buckle 46 creates a secure connection that is easily releasable by manually lifting up on release lever 57.

The second strap assembly 24 has a construction that is virtually identical to first strap assembly 23, including the primary strap portion 45*a* and a securing buckle 46*a*. The reference numeral suffix of "a" is being used to designate like component parts of second strap assembly 24 that correspond to first strap assembly 23. Some of these primary component parts include belt length 49*a*, tongue member 50*a*, and D-ring 53*a*. Cable 61 is used to securely connect to second strap assembly 24 using D-ring 53*a*. Cables 54 and 61 are each wound around a cooperating roller 62 that is positioned inside of the hollow tubular rail 31. Rod 39 extends through the outer wall of rail 31 and then through roller 62. Rod 41 extends through the outer wall of rail 31 at an adjustable location closer to seat 32 and then through its corresponding roller 62. This location is made adjustable by providing four sets of spaced apart (through) clearance holes 63, four sets on each side of apparatus 20, defined as through-holes by rails 30 and 31.

Cables 54 and 61 are securely joined to main cable 64 that extends out of proximal end 31*b* of rail 31 such that pulling on main cable 64, as if to pull it out of end 31*b*, causes cable 54 and 61 to concurrently and uniformly pull on D-rings 53 and 53*a*, respectively. The connection of cables 54 and 61 to main cable 64 is performed in a way so as to equalize or balance the pulling force so that the tensioning of the first and second strap assemblies 23 and 24 is substantially equal in response to the single pulling force on main cable 64. End cap 65 closes proximal end 30*b* of rail 30 while end cap 66 is shaped with a central opening for clearance with cable 64.

Figure 3:
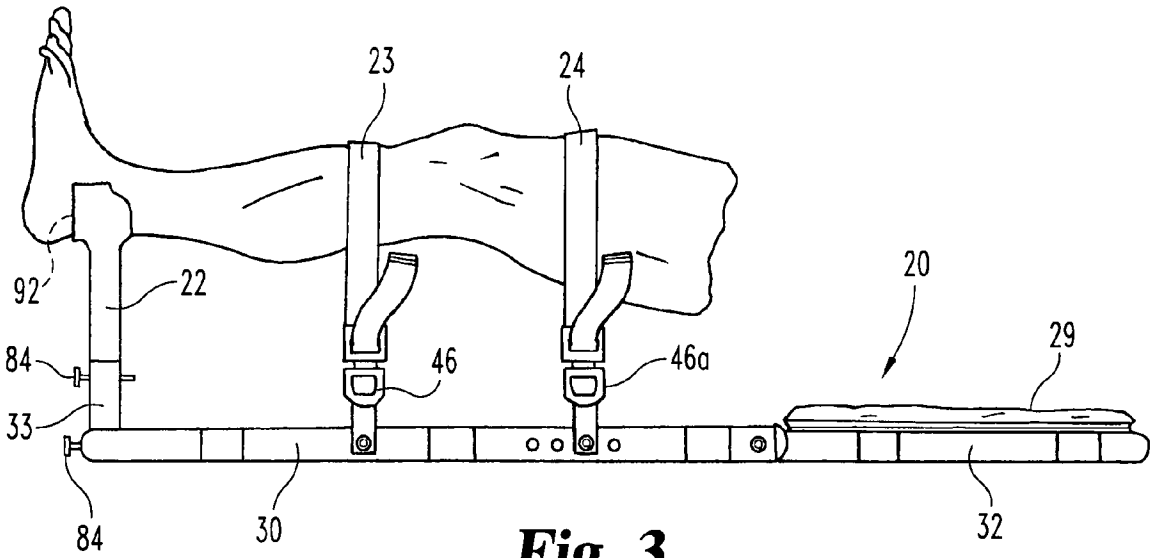
FIG. 3 is a side elevational view of the FIG. 1 knee extension treatment apparatus with a leg of the user supported for treatment.

The proximal end 64*a* of cable 64 is arranged with a tongue member 68 for receipt by buckle 70 that is received by the ratcheted pulley 26 via pulley strap 69. The connection of tongue member 68 to cable 64 is facilitated by creating a loop 71 in the end 64*a* of cable 64 for connection to tongue member 68. The pulley strap 69 is secured to the pulley 26 such that, as knob 72 is turned, the strap is wound up (i.e., shortened). As the strap is wound up, the tension pulling on the first and second strap assemblies 23 and 24 tightens these assemblies and, as will be described, creates downward forces, one proximal to the knee and the other distal to the knee. This arrangement of the two strap assemblies 23 and 24 relative to the leg of the user is illustrated in FIG. 3. Similar to what has been described as part of the parent application, that application being incorporated by reference herein, the substantially horizontal force pulling on cable 64 in a direction that is substantially parallel to the frame assembly and seat, in the FIG. 1 orientation, is translated into downward forces, one downward force being proximal to the knee and the other being distal to the knee. Both forces are directed toward the frame assembly and are substantially normal to the frame.

When utilizing apparatus 20 for knee treatment, it is assumed that the leg of the user will be bent at the knee as the user rests in a recumbent position on seat 32 with the ankle supported in an elevated position by ankle support 22. The treatment process includes applying a knee-proximal downward force and a knee-distal downward force against the upper surface of the leg in an attempt to straighten the leg by taking out the bend at the knee. This process involves stretching of the muscles that affect the knee joint and requires being able to apply enough force for the required stretching and then maintaining that force level during the stretching process. This procedure also requires that as the leg begins to straighten, any slack that might be available in terms of the cable/strap arrangement can be taken up (i.e., tightened), such that the overall length of that cable/strap arrangement is shortened by winding up some portion of strap 69 onto the ratcheted pulley 26.

As the cable/strap network is tightened, there is a need to maintain the force level so as to continue the stretching process. The ratcheted pulley 26 performs this desired (unidirectional) function, a capability inherent in its construction and inherent from the definition of "ratcheted". The finite adjustments that are available depend on the ratchet tooth size and spacing. What occurs is that, as the slack in the cable/strap arrangement is coiled onto the ratcheted pulley, the ratcheted arrangement allows the pulley to notch into the next tooth location and the unidirectional construction for the ratcheted pulley holds that position. A simple release latch is all that is required to release the ratcheted pulley, allowing the pulley to freely rotate in either direction. The use of the ratcheted pulley allows the user to maintain the desired force level by using a simple mechanical device and enables the user to readily increase the force level, as required, by simply winding up any cable/strap slack onto pulley 26.

As the forces on the leg need to be increased, as part of the treatment of the knee and the overall treatment procedure, there will be the need to shorten strap 69 by the continued turning of knob 72. If the necessary or desired torque on knob 72 is not able to be easily effected manually, the available removable torque lever 27 can be fitted over knob 72 and used for its mechanical advantage. The increased moment arm makes it easier to turn knob 72 when a higher force level on the leg is desired. The outer peripheral surface of knob 72 is contoured with an alternating series of raised ribs and recesses. The interior of the cylindrical hub 27*a* of lever 27 is compatibly contoured with a reverse series of raised ribs and recesses. In this way, the hub 27*a* fits securely over knob 72 so as to increase the moment arm for easier turning of the ratcheted pulley 26. The lever 27 is removed from the knob for transport and/or storage of apparatus 20.

Referring again to FIG. 1, leg slipcover 28 includes a fabric or nylon webbing panel 77 that includes three width-wise securing straps 78*a*-78*c* that are sewn to panel 77 at the three spaced-apart locations as illustrated in FIG. 1. Additionally, there are four end strap lengths 78*d*-78*g* also sewn to panel 77, two strap lengths at each end. Each strap 78*a*-78*c* includes a free end strap length at each end and a VELCRO® combination that is used to secure each free end strap length to itself. Each strap length 78*d*-78*g* also includes a VELCRO® combination such that each strap length can be wound around a portion of frame assembly 21, as illustrated, and then secured to itself. Strap lengths 78*d* and 78*e* are each wrapped around lower tube 34 so as to help secure the leg slipcover 28 to frame assembly 21. Strap length 78*f* is wrapped around the tubular joint where T-section 33 inserts into distal end 30*a*. Strap length 78*g* is wrapped around the tubular joint where T-section 33 inserts into distal end 31*a*.

Seat cushion 29 is constructed and arranged into two connected pad portions 29*a* and 29*b*. Pad portion 29*a* is connected to seat frame 80 by the use of six strap lengths 79*a*-79*f*. Each of these strap lengths includes a VELCRO® combination such that each strap length 79*a*-79*f* can be wound around seat frame 80 and secured to itself.

Portion 29*b* is joined to portion 29*a* by flexible web 81. Depending on the desired seat cushion thickness for a particular user, portion 29*b* can be flipped over onto portion 29*a* for added thickness, or left as illustrated in FIG. 1 for less seat cushion thickness.

The structural configuration of treatment apparatus 20 includes a number of adjustments that are included in order to try and customize, at least to some extent, the treatment apparatus 20 to "fit" the end user who will be, for example, an individual trying to work with the knee in order to avoid knee surgery or an individual providing treatment to the leg/knee following a surgical procedure, or perhaps building up the knee prior to contemplated surgery.

The first two adjustments relate to ankle support 22 and its orientation relative to the remainder of treatment apparatus 20. Included as cooperative component parts for these two adjustments are T-section 33, distal ends 30*a* and 31*a*, and push pins 84 (handled). T-section 33 includes first and second reduced diameter portions 33*a* and 33*b* that insert into distal ends 30*a* and 31*a*, respectively. The first reduced diameter portion 33*a* includes a receiving hole 85 for one push pin 84. Distal end 30*a* includes a plurality of clearance holes 86 allowing T-section 33 to be rotated relative to the distal ends in order to change the angle of incline or tilt of the vertical axis 87 (see line 87) extending lengthwise through ankle support 22. When push pin 84 is removed, the ankle support 22 is collapsible by pivoting downwardly toward seat 32 for transport and/or storage. The spacing and the number of holes 86 determines the number of different settings and the amount or extent of incline in terms of the orientation of axis line 87. It will be noted that the location and number of holes 86 can be either clockwise or counterclockwise from vertical such that the ankle support 22 can be tilted off of true vertical toward the seat or tilted off of true vertical away from the seat. In terms of use of the ankle support 22 and its adjustment, once hole 85 is aligned with the selected one of the plurality of holes 86 for the desired angle of incline, push pin 84, which includes a handle-like head, is inserted through hole 86 and into hole 85 in order to fix the relationship between T-section 33 and the left-side and right-side tubular rails 30 and 31, respectively. In order to change the angle of incline, which of course could include a true vertical orientation, the user simply pulls out the push pin 84, selects another hole 86, and then aligns hole 85 with the selected hole 86, and reinserts the push pin 84.

The second adjustment involves the height of ankle support 22 relative to the remainder of the frame 21 and importantly relative to the surface of seat 32 that is supporting the user. Ankle support 22 includes a reduced diameter portion 22*a* that inserts into tubular sleeve 89 of T-section 33. Portion 22*a* includes a plurality of clearance holes 90 and sleeve 89 includes a cooperating clearance hole 91. Push pin 84 is used to pin together portion 22*a* and sleeve 89 once the ankle support 22 is set at the desired height. The number and spacing of holes 90 determines the number of different height settings that are possible for ankle support 22. The different height settings are directed to the location of support surface 92 of ankle support 22 relative to frame assembly 21 and ultimately relative to the support surface 93 of seat 32. While support surface 93 is selected in FIG. 2 as the upper surface of support plate 96, the support surface 93 becomes the upper surface of cushion 29 if the cushion is used. As illustrated in FIG. 3, the desire is to try and position the ankle support surface 92 at a location or height above that surface where the user is "seated" (i.e., in a recumbent position) so as to take into consideration the anatomy of the user and the appropriate elevation of the leg for the selected treatment procedure. This particular adjustment enables the user of treatment apparatus 20 to configure that apparatus to better fit his or her anatomy.

Another point of adjustment is provided by the left-side and right-side tubular rails 30 and 31, respectively, relative to the location of second strap assembly 24. This in turn determines where the primary strap portion 45*a* will be positioned relative to the leg of the user, and more specifically where it will be positioned relative to the knee of the user.

Each tubular rail 30 and 31 includes a series of four spaced-apart clearance holes 63 that are aligned so as to receive threaded rod 41 that is inserted through hollow tube 37. As previously described, the second strap assembly 24 is assembled to frame assembly 21 by this rod and sleeve combination, including wing nuts 40*b*. Accordingly, the selection of a particular clearance hole in each tubular rail 30, 31 determines where the primary strap portion 45*a* will be located relative to seat 32, ankle support 22, and the first strap assembly 23.

A further point of adjustment is provided by the point of connection of the ratcheted pulley 26 relative to the support plate 96 that cooperates with frame 80 to form seat 32, without pad portions 29*a* and 29*b*. Plate 96 includes a series of four spaced-apart clearance holes 97 for the attachment of mounting plate 98. Bolts 99 and wing nuts 100 complete the assembly. Mounting plate 98 includes a shoulder bolt 101 for the attachment of the ratcheted pulley (and buckle) assembly 26. Depending on the size of the user, and the positioning of the user's torso and right arm relative to the ratcheted pulley 26 location, there are three different positions that are available for the attachment of mounting plate 98 onto plate 96. More adjustment positions can be made available by increasing the number of clearance holes 97.

Figure 4:
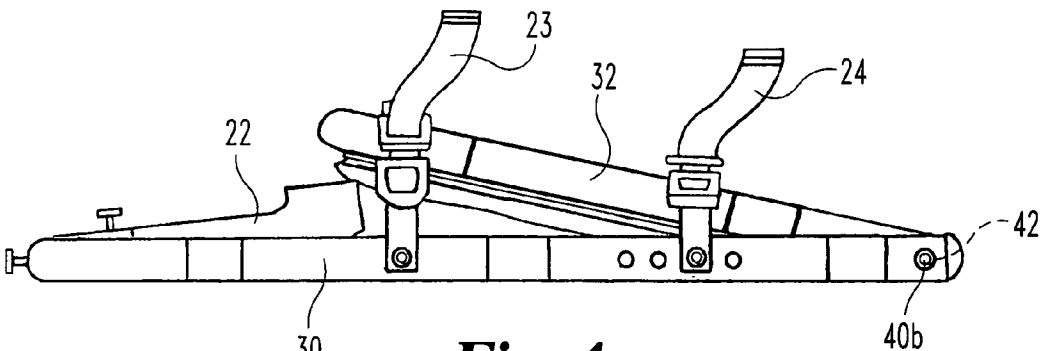
FIG. 4 is a side elevational view of the FIG. 1 knee extension treatment apparatus as arranged into a folded configuration for transport or storage, according to the present invention.

A further feature of the present invention that is enabled by its specific construction is the ability to fold the seat 32 forwardly and downwardly in the direction of the tubular rails 30 and 31, see FIG. 4. A related feature is the ability to fold the ankle support 22 and T-section 33 rearwardly and downwardly in the direction of the tubular rails 30 and 31, also illustrated in FIG. 4.

Folding of the seat 32 is enabled by the rod 42 and lower tube 34 assembly and the use of bushings 43. Since the seat is intended to be placed flat on the support surface used for treatment apparatus 20, this point of connection by way of rod 42 does not have to be fixed or secured in terms of pivoting or hinging, but rather should be hinged or pivotable for the forward folding of the seat.

Once treatment apparatus 20 is placed into the folded condition of FIG. 4, the first and second strap assemblies 23 and 24, respectively, are used to secure the seat in the illustrated folded condition. The ankle support 22 and T-section 33 are actually folded rearwardly first so that the seat 32, once folded, can be used to secure and actually clamp down onto the ankle support 22, as is illustrated in FIG. 4. When the two strap assemblies 23 and 24 are buckled around the back of the folded seat, treatment apparatus 20 is configured into a transport and/or storage arrangement. The lightweight and portable nature of treatment apparatus 20 creates a uniquely attractive treatment apparatus as compared to those larger, more bulky and cumbersome designs that do not have any aspect of portability. For the present invention, lightweight materials have been used in terms of the nylon webbing and straps, hollow tubular frame members, and a minimum of component parts all provide to the lightweight and portable nature of treatment apparatus 20. The simple construction and ease of assembly and disassembly of the various component parts also enables any required repairs to be made easily by the user without having to discard perfectly good component parts because they are welded together or fixed in some fashion that they must be discarded with the damaged part.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A knee extension treatment apparatus for applying a downward force to an upper surface of a user's leg that is supported by said knee extension treatment apparatus for facilitating the straightening of the leg when bent at the knee, said knee extension treatment apparatus comprising:

a base frame assembly including a hinged seat portion;

a collapsible ankle support subassembly connected to said base frame assembly, said collapsible ankle support subassembly including an ankle support and a T-section, the T-section being pivotally adjustable relative to said base frame assembly and receiving a portion of said ankle support, said ankle support including an elevated support surface for receiving the user's ankle, said ankle support being adjustable in height relative to said T-section; and first and second strap assemblies connected to said base frame assembly, each strap assembly being secured at one end to said base frame assembly and constructed and arranged to lay over the upper surface of the user's leg, an opposite end of each strap assembly being movable by the user whereby pulling said opposite end creates a downward force on the upper surface of the user's leg.

2. A knee extension treatment apparatus for applying a downward force to an upper surface of a user's leg while that leg is supported by said knee extension treatment apparatus for facilitating the straightening of the leg when bent at the knee, said knee extension treatment apparatus comprising:

a base frame assembly;

support means for elevating the user's leg;

first and second strap assemblies connected to said base frame assembly, each strap assembly being secured at one end to said base frame assembly and constructed and arranged to lay over the upper surface of the user's leg, an opposite end of each strap assembly being movable by the user whereby pulling said opposite end creates a downward force on the upper surface of the user's leg; and a ratcheted pulley assembly connected to said first and second strap assemblies for maintaining a selected tension on each strap assembly as established by the user, said ratcheted pulley assembly including a control knob and a removable torque lever for increasing the moment arm.

3. A knee extension treatment apparatus for applying a downward force to an upper surface of a user's leg that is supported by said knee extension treatment apparatus for facilitating the straightening of the leg when bent at the knee, said knee extension treatment apparatus comprising:

a base frame assembly including a hinged seat portion;

a collapsible ankle support subassembly connected to said base frame assembly, said collapsible ankle support subassembly including ankle support and a T-section, the T-section being pivotally adjustable relative to said base frame assembly and receiving a portion of said ankle support, said ankle support including an elevated support surface for receiving the user's ankle, said ankle support being adjustable in height relative to said T-section; and at least one strap assembly connected to said base frame assembly, said at least one strap assembly being secured at one end to said base frame assembly and constructed and arranged to lay over the upper surface of the user's leg, an opposite end of said at least one strap assembly being movable by the user whereby pulling said opposite end creates a downward force on the upper surface of the user's leg.

4. A knee extension therapy apparatus for use by a patient in a recumbent position with his foot elevated to a level above the surface upon which the patient user is resting, said apparatus comprising:

a base having a patient user distal portion and a patient user proximal portion with a surface for supporting the patient user's hip, said base including a frame having tubular side rails;

an ankle support member mounted on the patient user distal portion of the base, said ankle support member being height adjustable and being pivotally mounted for positioning between an upright patient ankle support position and a folded storage position;

a cable system for translating a force applied by the patient toward the patient proximal end of the base and having a major vector component generally parallel to the surface of the base to a force having a major vector component substantially orthogonal to the surface of the base, said cable system including ratchet means for maintaining a patient predetermined force setting, absent continued patient interaction; and a force transmitting element for engaging both knee proximal and knee distal portions of the patient's elevated leg, said element having at least one connector for attaching said element to the cable system for applying the translated base-orthogonal force to the top of the patient's leg toward said base, wherein a portion of the cable system extends through a portion of one tubular side rail.

* * * * *